United States Patent [19]

Diamant

[11] 4,384,382

[45] May 24, 1983

[54] DISPOSABLE TOOTHBRUSH COVER

[76] Inventor: Marcus Diamant, Kungsgatan 1, S-302 45 Halmstad, Sweden

[21] Appl. No.: 245,063

[22] Filed: Mar. 18, 1981

[51] Int. Cl.[3] ..... A47L 13/00; A46B 17/04; A46B 9/04

[52] U.S. Cl. ..... 15/104 R; 15/167 R; 15/227; 15/247; 15/209 R; 128/62 A

[58] Field of Search ..... 15/104 R, 247, 227, 15/114, 115, 116, 110, 209 R; 128/62 A

[56] References Cited

U.S. PATENT DOCUMENTS

| | | | |
|---|---|---|---|
| 1,318,964 | 10/1919 | Chess | 128/62 A |
| 2,016,951 | 10/1935 | Welker | 128/62 A |
| 2,172,600 | 9/1939 | Werth | 15/247 |
| 2,419,896 | 4/1947 | Hobelmann | 128/62 A |
| 2,976,554 | 3/1961 | Hromoko et al. | 15/167 R |
| 4,195,625 | 4/1980 | Bukowski | 128/62 A |

FOREIGN PATENT DOCUMENTS

| | | | |
|---|---|---|---|
| 236990 | 7/1925 | United Kingdom | 15/247 |

*Primary Examiner*—Peter Feldman

*Attorney, Agent, or Firm*—Otrolenk, Faber, Gerb & Soffen

[57] ABSTRACT

A protective cover for a toothbrush, the cover being intended for use once only. The cover has one part adapted to enclose a part of the toothbrush handle and another part adapted to enclose the toothbrush head. That part of the cover surrounding the brushing head is, if required, also constructed with brushing means having a continuous brushing surface. A cover formed in this way can also be used in combination with an ordinary toothbrush, or with a toothbrush whose brushing head comprises a suitable soft member. That part of the cover which surrounds the brushing head is substantially secured against movement relatively to the brushing head.

5 Claims, 9 Drawing Figures

DISPOSABLE TOOTHBRUSH COVER

BACKGROUND OF THE INVENTION

This invention relates to a cover for use on a toothbrush head.

Good dental hygiene is considered important for the prevention of dental caries and the regular brushing of teeth and gums is generally recommended for good dental hygiene. Although the recommended technique for brushing teeth has changed in line with recent development, the question has arisen as to whether tooth brushing itself may in some case cause certain damage, e.g. the wedge-shaped defects that are often found at the transition between the tooth and the tooth neck. Another question that has arisen is whether the formation of the even more common tooth pockets is promoted by the excessive brushing of teeth, since some people brush their teeth intensively, in many cases for some five minutes at a time, several times a day. One reason why teeth are brushed for this relatively long time, is that ideally brushing should be carried out until all bacterial have been removed from the teeth. However, to remove all the bacteria from the teeth by brushing alone is probably quite impossible. Moreover, we all have a bacterial flora in the mouth and throat, and this rapidly spreads to the teeth. In addition, once a toothbrush has been used it is never free from bacteria and during its subsequent use it deposits its bacteria on the teeth, gums and any tooth pockets.

OBJECT OF THE INVENTION

The object of this invention is to provide a tooth brushing means which allows satisfactory dental hygiene and at the same time reduces the risk of damage to the teeth and the occurrence of tooth pockets.

SUMMARY OF THE INVENTION

The invention includes a cover adapted to be fitted to the head of a toothbrush, as described below, in which the conventional brush, made up of multiple bristles with free tips on the toothbrush head, is replaced by brushing elements of elastically resilient material, the brushing surfaces of which are constructed in the form of turns of filamentary material, a number of such brushing elements being disposed substantially transversely or obliquely of the longitudinal direction of the handle.

A preferred brush of this type consists of a member of filamentary material substantially in the form of a helical spring and having at least some turns of filamentary material or groups of turns of filamentary material separated from adjacent turns of filamentary material or groups of turns of filamentary material.

The turns of filamentary material may be of different sizes and, if required, may have a flattened portion in the brushing surface.

However, the cover of the present invention may be used with any type of toothbrush.

The invention provides a disposable cover adapted to be fitted to a toothbrush provided with a brushing head and a handle, the cover consisting of flexible sheet material and having an open end with an adjacent part adapted to enclose a part of a handle of the toothbrush and a closed end with an adjacent cover part adapted to surround the brushing head connected to the handle of the toothbrush, the cover being constructed to so fit against the toothbrush that during brushing of the teeth with the cover in position that part of the cover which is adapted to surround the brushing head is substantially secured against movement relatively to the head.

Assuming that the cover is used once only, it is free from harmful bacteria which would be planted on the teeth, gums and any tooth pockets when it is used. Moreover, tooth cleaning is much gentler than would be the case if one merely used a conventional toothbrush with its bristle points, so that damage to the teeth and tooth pockets is not promoted, especially if the preferred type of brush described herein is used within the cover.

Advantageously, the fit of the cover is such that at least that part of the cover which is adapted to surround the handle is turned inside out on removal of the cover from the toothbrush by drawing the open end towards the closed end. When the cover is reversed on removal from the toothbrush bacterial initially on the outside of the used cover are thus contained within the reversed cover.

To assist the reversal operation, the open end of the cover is advantageously constructed with a special reversing means, e.g. a lobe formed in the cover material and/or a strip, thread or the like secured in the cover at one end and extending from the cover.

Advantageously, that part of the cover which is adapted to surround the toothbrush has at least the same length as that part of the cover which is intended to surround the brushing head. This reduces the risk of the toothbrush inserted in the cover being contaminated by oral cavity or dental bacteria, while the used outside of the cover is enclosed even if the cover is only partially reversed.

Advantageously, that part of the cover which is adapted to surround the brushing head is adapted to fit tightly around the same. This facilitates complete reversal of the cover and gives increased security against relative movement between the cover and the head during brushing of the teeth.

The above advantages are achieved to a greater degree if the flexible sheet material of which the cover is made consists of polymer material with at least some elasticity. Such a material is also relatively cheap, so that the cover can be manufactured at a reasonable price.

Preferably, that part of the cover which is adapted to surround the brushing head has surface irregularities which increase the brushing efficiency. These irregularities may, for example, be applied to the cover or formed in the actual cover material, e.g. longitudinal, transverse or oblique folds, or else may be irregularities which give the outside of the cover a roughened structure.

The cover may be used with a conventional toothbrush, but it is preferred to use the cover with a toothbrush which has a head comprising an elastically resilient soft member with an elasticity adapted to tooth brushing. This eliminates any risk that the bristle points of a conventional toothbrush (if used inserted in the toothbrush cover according to the invention) might cause local tooth damage.

Advantageously, the soft member has surface irregularities which increase the brushing efficiency. A smooth cover may be used in these conditions, but it is also possible to use toothbrush having a smooth soft member together with a cover formed with surface irregularities. Of course both the soft member and the cover may have surface irregularities preferably so arranged as to complement one another. For example, one may be constructed with folds in one direction and the other with folds in another direction intersecting the first direction.

DESCRIPTION OF PREFERRED EMBODIMENTS

Figure 1:
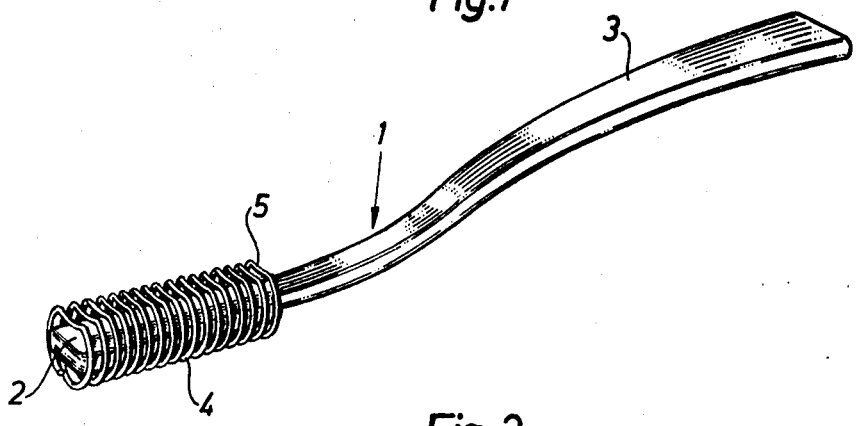
FIG. 1 is a perspective view of a preferred embodiment of a toothbrush adapted, when used, to be introduced into a disposable toothbrush cover constructed according to the invention.

Like conventional toothbrushes, the toothbrush 1 shown in FIG. 1 comprises a brush head 2 and a handle 3 which carries the brush head. Unlike the head of conventional toothbrushes, the head 2 does not comprise a plurality of bristles having free tips. Instead, the brush head comprises an elastically resilient soft member, the elasticity of which is selected so that the member acts satifactorily when used for cleaning teeth. In the embodiment shown in FIG. 1, the soft member comprises a member 4 of elastically resilient filamentary material, having substantially the form of helical spring. In filamentary material members of this kind it is advantageous for at least some of the filaments turns to be separated from adjacent turns, thus producing surface irregularities which increase the brushing efficiency. In the embodiment shown in FIG. 1, therefore, all the filament turns are separated from adjacent turns so that they are situated at substantially constant spacing from one another along the axis defined by the handle 3. The filamentary member 4, is fixed to the handle 3 in any of several ways well known to those versed in the art, e.g. by integral molding, fusing, or gluing, each of the filament turns in or against the sides of the handle 3. Each turn of the filamentary member 4 has a flattened portion 5 and it is this flattened portion that is intended to be placed against the teeth during brushing. Each turn extends across the entire width of the handle. In a modified embodiment illustrated in FIG. 7, the filamentary member 4 is constructed substantially in the form of a helical spring, which does not have any flattened portions as in the embodiment shown in FIG. 1.

Figure 7:
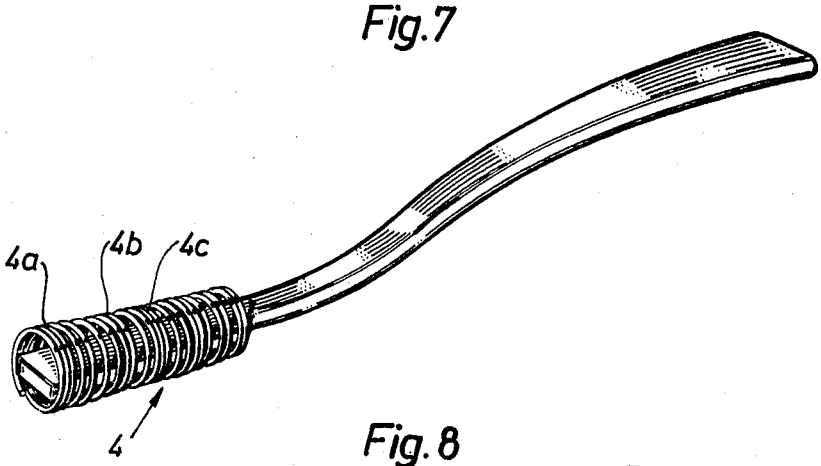
FIG. 7 is a perspective view of another embodiment of a preferred embodiment of a toothbrush head.

In the embodiment shown in FIG. 7 the member 4 consists of groups of filamentary turns 4*a*, 4*b* and 4*c* respectively, which are separated from adjacent groups. Thus the filamentary turns in the groups are close together, but the groups are spaced apart. In a modification not shown in the drawing, the filaments may be very much thinner, in the respective groups.

In the embodiments shown in FIGS. 1 and 7 the individual filamentary turns are substantially at right angles to the longitudinal direction of the handle 3, but in a modification within the scope of the invention the turns may be oblique. Thus the filamentary turns may extend obliquely over the handle.

Figure 2:
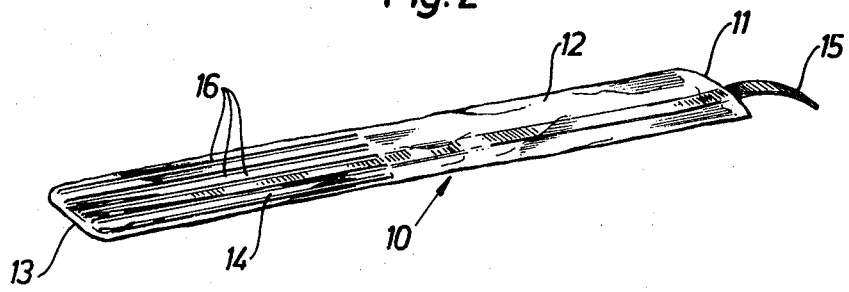
FIG. 2 is a perspective view of a first preferred embodiment of such a toothbrush cover according to the invention.

The toothbrush cover 10 shown in FIG. 2 is intended for disposable use and consists of flexible sheet material. It has an open end 11 with an adjacent part 12 adapted to surround part of the handle 3 of the toothbrush 1, and a closed end 13 with an adjacent part 14 intended to surround the toothbrush head 2 which is constructed as a soft member. As will be apparent from FIG. 3, the cover 10 is also so constructed as to fit so closely against the toothbrush 1 that during brushing of the teeth with the cover on the brush that part 14 of the cover which is intended to surround the brushing head 2 is substantially secured against movement relative to the head 2. In the preferred embodiment shown in FIGS. 2 and 3, the arrangement is such that at least the cover portions 12 surrounding the handle 3 is turned inside out on removal of the cover 10 from the toothbrush 1 by drawing the open end 11 towards the closed end 13.

To assist this operation, the open end 11 of the cover 10 may be constructed with a special device 15. In the embodiment shown in FIGS. 2, and 3, the device for turning the cover inside out comprises a strip 15, one end of which is advantageously secured to the closed end 13 of the cover 10, while it extends out of the open end 11 of the cover. The strip, which could be replaced by thread of the like without changing its function, is illustrated as being secured to the cover at a point which is an appreciable distance from the open end 11 of the cover. This securing point may be situated at or near the point where the part 12 of the cover merges into the part 14. In some cases the securing point could, however, be situated right inside at the closed end 13 of the cover, in which case, however, when the toothbrush is introduced into the cover 10 care should be taken to ensure that—if the soft member has surface irregularities to increase the brushing efficiency—the strip 15 does not assume a position between the surface irregularities and the teeth during brushing.

The device 15 may also be of different construction. In another embodiment (not shown) the cover 10 may be constructed with a preferably wedge-shaped slot, in which case a lobe in the cover material projecting through the slots forms the reversing device 15.

Figure 3:
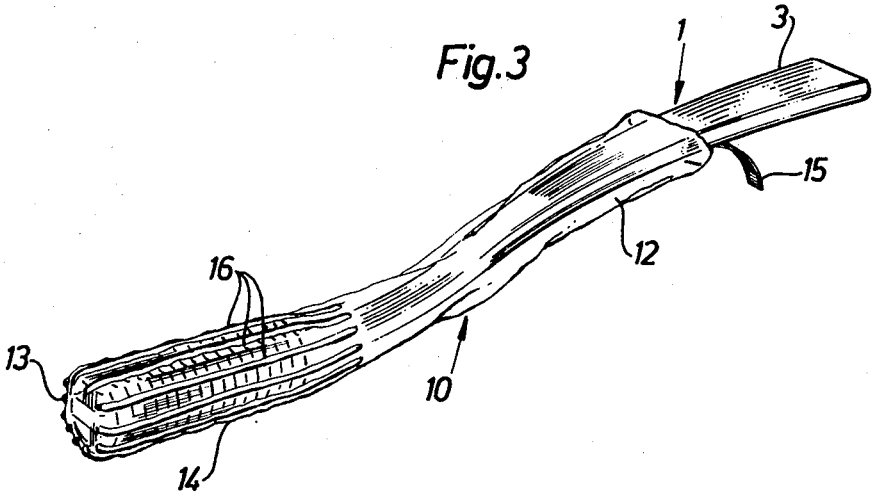
FIG. 3 is a perspective view showing the toothbrush according to FIG. 1 inserted in the cover according to FIG. 2.

It will be apparent from FIGS. 2 and 3 that in the preferred embodiment illustrated the part 12 of the cover surrounding the handle 3 has at least the same length as the part 14 surrounding the soft member 2, which is adapted to fit closely around said soft member 2.

The flexible sheet material of which the cover 10 is made preferably consists of polymer material, e.g. any suitable thermoplastics, with at least some elasticity.

In the preferred embodiment shown in FIGS. 2 and 3, the part 14 surrounding the soft member 2 has surface irregularities 16 to increase the brushing effect. These are disposed over the entire length of part 14 of the cover and at least on that part of the surface of the cover portion 14 which is adapted to come into contact with the teeth. They are therefore situated at least on the brushing side but need not be provided on the "back" of the cover 10. In the embodiment shown in FIGS. 2 and 3, the surface irregularities comprise parallel ridges 16 provided on the surface of the part 14 of the cover and extending in the longitudinal direction of the cover 10. They intersect the turns of filamentary material of the member 4 illustrated substantially at right angles to form, at the points of intersection, a plurality of raised surface irregularities arranged in a chequer pattern.

Figure 5:
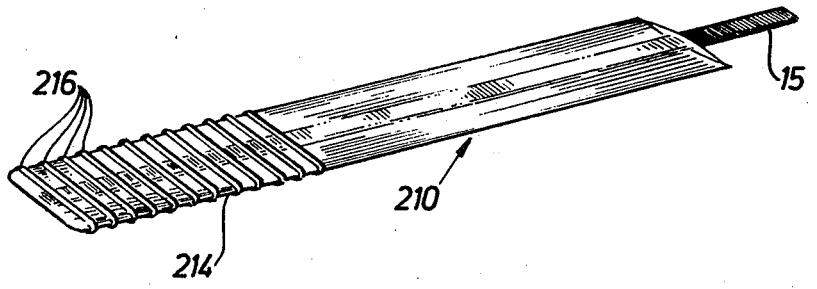
Figure 6:
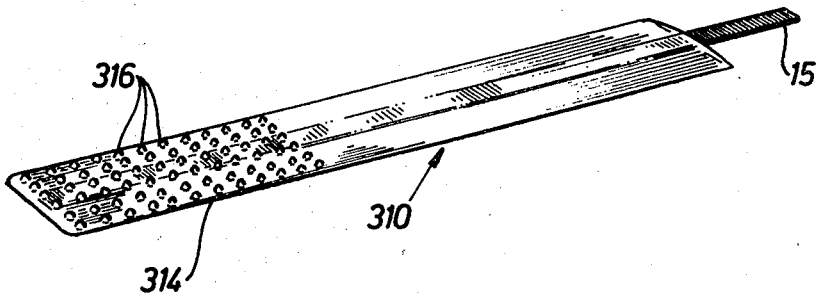

The toothbrush cases 110, 210 and 310 shown in FIGS. 4, 5 and 6, differ from the case shown in FIGS. 2 and 3 only in respect of the surface irregularities, so that only the differences will be noted below.

Figure 4:
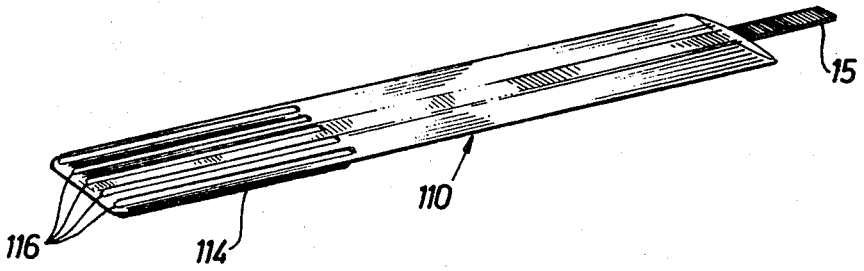
FIGS. 4, 5 and 6 are similar perspective views to FIG. 2 of a second, third and fourth preferred embodiments of the toothbrush cover according to the invention.

In the embodiment shown in FIG. 4, the surface irregularities increasing the brushing efficiency consist of parallel grooves 16 impressed in the material of the casing portion 114, said grooves extending longitudinally of the cover 110 over the entire length of part 114 thereof. In the embodiment shown in FIG. 5, the surface irregularities consist of grooves impressed from below in the material of the part 214 of the casing, so that corresponding ridges 216 are formed on the top of the part 214. The ridges 216 are parallel with one another transversely of the longitudinal direction of the cover 210 and, as they extend around the periphery of part 214, give that part a bellows-like appearance. FIG. 6 shows an embodiment in which the surface irregularities consist of recesses impressed point-wise from below in the material of the portion 314 of the cover so that corresponding point-wise projections 316 arise on the top of the portion 314. The projections 316 are arranged in a chequer pattern with rows extending both longitudinally, transversely and obliquely in relation to the longitudinal direction of the cover 310.

Figure 8:
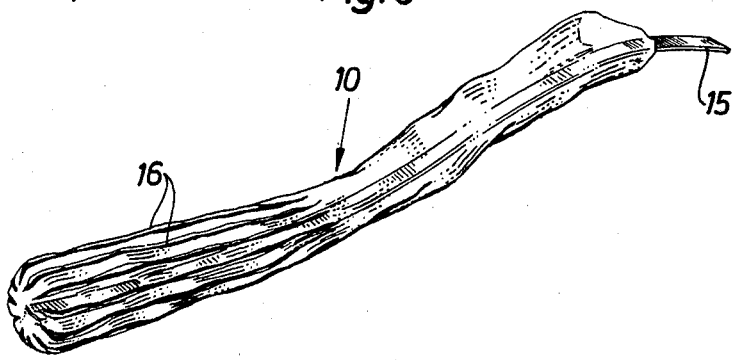
FIGS. 8 and 9 are perspective views of other embodiments of the toothbrush cover.
Figure 9:
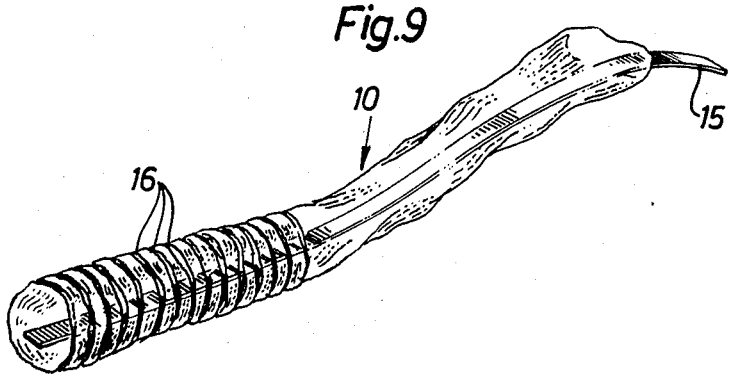

FIGS. 8 and 9 show some cover constructions in which the surface irregularities are in the form of folds, projections or the like provided directly in the cover material.

Of course both the ridges 216 and the projections 316 (like the ridges 16) are provided by the use of suitable material as shown in FIGS. 8 and 9. It will also readily be seen that a cover provided with surface irregularities of any shape can be used together with a toothbrush having a smooth soft member and that a smooth cover can be used together with a toothbrush whose soft member is provided with surface irregularities of any form, and that if both the cover and the soft member are provided with surface irregularities they should advantageously complement one another, e.g. by intersecting one another.

The toothbrush covers according to the invention are advantageously made in the form of a strip-shaped multiple packing comprising a plurality of toothbrush covers secured in the flattened state adjacent one another mounted on a continuous web of paper or the like, the covers being separable. For production purposes, a continuous first plastics web which, if desired, is provided with reversing means, e.g. in the form of strips extending substantially at right angles to the longitudinal direction of the web, and a second plastic web which, if required, is provided with surface irregularities in the manner indicated hereinbefore, and a web of paper or the like, may be combined. The resulting combined continuous web is then treated by joining methods known from plastics technology, e.g. hot sealing or the like, to give flattened toothbrush covers disposed adjacent one another, the covers being separable from one another and from the paper web, but having a weak adhesion to the web at least along the side joints common to the toothbrush covers. By gently drawing the reversing strip in a direction perpendicular to the plane of the multiple pack, the open end of the flattened toothbrush cover can be made to open so that introduction of the toothbrush into the cover is facilitated. After introduction the cover with the toothbrush inserted can easily be removed from the paper web by pivoting the toothbrush, about its inserted end, in an upward direction away from the paper web.

Although particular embodiments of the invention have been described and illustrated herein, it is recognized that modifications may readily occur to those skilled in the art, and consequently it is intended that the following claims be interpreted to cover such modifications and equivalents.

What is claimed is:

1. A disposable cover adapted to be fitted to a toothbrush wherein said toothbrush has a brushing head and a handle;

said cover comprising a substantially tubular member of flexible sheet material having an open end adapted to extend along the handle of said toothbrush and a closed end adapted to extend and surround the brushing head carried by the handle of the toothbrush;

said cover being constructed to fit against a toothbrush in such manner that during brushing the teeth with the cover in position, that part of the cover which is adapted to encase the brushing head is substantially secured against movement relative to the said brushing head;

said flexible tubular cover being formed of flexible polymer material having at least some elasticity;

and the surface of that portion of the cover which is adapted to surround the brushing head having surface irregularities which increase the brushing efficiency of the brush when the cover is in position;

said tubular cover being so arranged that the part of the cover which extends along and encases the toothbrush handle is turned inside out on removal of the cover from the toothbrush by drawing the open end toward the closed end;

and additional means connected to and through said open end of said tubular cover for facilitating the turning of the cover inside out so that bacteria on the outside of the used cover are thus contained within the reversed cover;

said additional means comprising an elongated flexible member secured to the interior of the cover and extending substantially the whole length and through the open end thereof.

2. A cover according to claim 1, wherein that part of the cover which is adapted to surround the toothbrush handle has at least the same length as that part of the cover which is intended to surround the brushing head.

3. A toothbrush cover according to claim 1 wherein that part of the cover which is adapted to surround the brushing head is adapted to fit tightly around the same.

4. The toothbrush cover of claim 1 in combination with a toothbrush wherein the said toothbrush brushing head is formed by a plurality of resilient elements spaced from each other in the direction of the axis of the handle; each of the elements extending substantially transversely of the handle.

5. The toothbrush and cover combination of claim 4, wherein said brushing head comprises filament turns arranged to resemble a helical spring.

* * * * *